United States Patent [19]

Murata et al.

[11] Patent Number: 5,051,279

[45] Date of Patent: Sep. 24, 1991

[54] HIGH-GRADE THERMAL RECORDING SHEET AND A METHOD OF MAKING THE SAME

[75] Inventors: Masayuki Murata; Shinichiro Katsuta; Tomoyuki Unno, all of Fuji, Japan

[73] Assignee: Kohjin Co., Ltd., Tokyo, Japan

[21] Appl. No.: 425,233

[22] Filed: Oct. 23, 1989

Related U.S. Application Data

[62] Division of Ser. No. 144,032, Dec. 14, 1987.

[30] Foreign Application Priority Data

| | | | |
|---|---|---|---|
| Jun. 12, 1986 | [JP] | Japan | 61-134830 |
| Oct. 20, 1986 | [JP] | Japan | 61-247631 |
| Oct. 28, 1986 | [JP] | Japan | 61-254616 |
| Dec. 29, 1986 | [JP] | Japan | 61-313215 |
| Apr. 14, 1987 | [JP] | Japan | 62-89820 |

[51] Int. Cl.[5] ..... B41M 3/12; B41M 5/30

[52] U.S. Cl. ..... 427/150; 427/151; 427/152; 503/200

[58] Field of Search ..... 427/150-152; 503/200, 226

[56] References Cited

U.S. PATENT DOCUMENTS 4,442,179 4/1984 Igarashi et al. ..... 428/220

FOREIGN PATENT DOCUMENTS 59-33180 2/1984 Japan ..... 503/200
59-143681 2/1984 Japan ..... 503/226
59-41295 3/1984 Japan ..... 503/226
59-133092 7/1984 Japan ..... 503/226

OTHER PUBLICATIONS

English Translation of "JIS-Japanese Industrial Standard Definitions and Designation of Surface Roughness"-JIS B 0601, International Search Report for PCT/JP87/00384.

*Primary Examiner*—Bruce H. Hess
*Attorney, Agent, or Firm*—Oliff & Berridge

[57] ABSTRACT

A thermal recording sheet having on a support a thermal recording layer adapted for developing color when heated has an outermost surface layer formed by bringing it into contact with the surface of a smooth body when it is in a wet state, drying it and separating it from the surface of the smooth body. The sheet has a surface which is so smooth that when a first straight line extending in parallel to the centerline of a roughness curve as obtained in accordance with the method of JIS B0601 crosses the roughness curve with a contact ratio of 10%, a second straight line extending in parallel to the centerline and between it and the first straight line and having a distance of 1.5 μm from the first straight line crosses the roughness curve with a contact ratio of at least 80%. The sheet is, therefore, easy to bring into intimate contact with a thermal head and is of high image quality and sensitivity. If the smooth body has a glossy or dull surface, it is possible to produce a thermal recording sheet having a uniformly glossy or dull surface without lowering its image quality of sensitivity.

8 Claims, 1 Drawing Sheet

HIGH-GRADE THERMAL RECORDING SHEET AND A METHOD OF MAKING THE SAME

This is a continuation of application Ser. No. 07/144,032 filed Dec. 14, 1987.

TECHNICAL FIELD

This invention relates to a high-grade thermal recording sheet of drastically improved image quality and sensitivity having a uniformly glossy or dull surface.

BACKGROUND ART

A thermal recording sheet usually comprises a heat-sensitive coloring layer provided on a support, such as paper or film, and consisting mainly of a heat-sensitive color-developing composition. It is used for recording a color image when heated by a thermal head or pen, a laser, etc. The thermal recording system has a variety of advantages over other recording systems. For example it is capable of quick recording, while requiring only a relatively simple apparatus, does not present any serious problem of noise or environmental pollution, and is inexpensive. Therefore, it is used for a wide range of applications, e.g. for facsimile devices, recorders, printers, ticket vending machines and label printers.

The recent improvement in the machines or apparatus with which the thermal recording sheets are used, and the development of new machines or apparatus have resulted in a demand for the correspondingly improved thermal recording sheets. For example, high image quality (dot reproducibility) and a uniformly glossy surface are required or preferred of the thermal recording sheets which are used with a CRT printer for producing a gradated image, or an instrumentation or label printer which is required to produce an image having a high contrast. On the other hand, a thermal recording sheet of high image quality and sensitivity having a dull surface is required for a facsimile device or an ordinary printer of the type which is principally used for producing a character image as it is of the prime importance that the characters which are reproduced are easy to read. Other recent improvements featuring all types of machines or apparatus under discussion have been a reduction in the power which is required for operating the machine or apparatus and a higher degree of resolution. These features have been calling for the development of a thermal recording sheet of appropriately improved sensitivity and image quality. Moreover, there has been a strong demand for a sheet having a uniformly glossy surface and a sheet having a uniformly dull surface which can be selectively used in accordance with any particular recording purpose.

It has hitherto been usual to manufacture a thermal recording sheet by coating a support, as of paper, with a heat-sensitive coloring layer, drying it and subjecting it to smoothing treatment, as by a supercalender, to improve its surface smoothness and thereby obtain improved image quality and sensitivity. It has, however, been difficult to obtain any satisfactory thermal recording sheet of high image quality and sensitivity having a uniformly glossy or dull surface.

Various methods have been proposed for producing a thermal recording sheet of high surface smoothness which achieves an improved contact with a thermal head and thereby improved image quality and sensitivity. They include a method which employs supercalendering to obtain a Bekk smoothness of 200 to 1000 seconds (Japanese Patent Publication No. 20142/1977), a method which provides a thermal recording layer on an undercoat layer containing wax and supercalendering it until it has a surface roughness $R_z$ not exceeding 2 μm (Japanese Laid-Open Patent Specification No. 204594/1984), a method which employs supercalendering by hot metal rolls to obtain an optical surface roughness $R_p$ not exceeding 3.5 μm (Japanese Laid-Open Patent Specification No. 237683/1986) and a method which comprises applying a thermal recording layer by a bent coating blade, drying it and smoothing it to a surface roughness $R_a$ not exceeding 1.2 μm (Japanese Laid-Open Patent Specification No. 156086/1980). None of these methods has, however, been able to realize any surface smoothness providing satisfactory image quality or sensitivity. Moreover, there has not been available even any index of smoothness defining the level of image quality in a highly reliable way.

There have also been proposed various ways of producing a thermal recording sheet having an improved appearance. For example, Japanese Patent Publications Nos. 14531/1975 and 5947/1976 and Japanese Laid-Open Patent Specifications Nos. 46786/1981 and 64888/1985 propose certain recipes for the materials of a thermal recording layer which are intended for preventing it from being stained or having an uneven luster when it is calendered, and Japanese Laid-Open Patent Specification No. 155094/1984 proposes certain conditions for calendering. The unevenness of luster which is apparently due to the unevenness in formation of the support for a thermal recording sheet or the unevenness in coating of its thermal recording layer has been difficult to eliminate by any smoothing treatment, such as calendering. It has, therefore, been impossible to obtain any thermal recording sheet having a uniformly glossy surface. On the other hand, it has been usual to omit the smoothing treatment, such as calendering, or perform it only to a limited extent, in order to obtain a uniformly dull surface. It has, however, been possible to obtain only a thermal recording sheet of lower surface smoothness and therefore of low image quality and sensitivity.

SUMMARY OF THE INVENTION

Under these circumstances, it is an object of this invention to provide a high-grade thermal recording sheet of high image quality and sensitivity having a uniformly glossy or dull surface.

It is another object of this invention to provide a method of manufacturing any such thermal recording sheet.

The terms "roughness curve" and "ratio of contact between a roughness curve and a straight line" as herein used for describing and defining the invention have the following meanings, respectively:

Roughness Curve

This curve is a record on a chart of the results of roughness measurement which were obtained by employing a probe having a radius of curvature of 5 μm at its tip, a measuring pressure of 4 mN (0.4 gf), a scanning speed of 0.3 mm/sec., a measuring length of 2.5 mm and a cutoff value of 0.8 mm in accordance with the method of JIS B 0601. The measurement was made by using the apparatus manufactured by Tokyo Seimitsu K. K. and known as SURFCOM 1500A. The results of measurement are shown by way of example in FIG. 2.

Ratio of Contact

This ratio is obtained by drawing a straight centerline across a roughness curve in such a way that the total area of the surfaces surrounded by the centerline and the roughness curve on one side of the centerline may be equal to that of the surfaces surrounded by the centerline and the curve on the other side thereof, and another straight line extending in parallel to the centerline and across the curve, as shown in FIG. 2. It is the ratio of the sum of the lengths $L_1$, $L_2$ to $L_n$ of those portions of the parallel line which cross the curve, to a standard length L, and is expressed by the following formula:

$$\frac{L_1 + L_2 + \ldots + L_n}{L} \times 100\ (\%)$$

According to this invention, there is provided a method of manufacturing a high-grade thermal recording sheet having on a support an outermost surface layer defining a thermal recording layer adapted for developing color when heated, characterized by bringing the outermost surface layer into contact with the surface of a smooth body when the layer is in a wet state, drying it and separating it from the surface of the smooth body.

Some preferred aspects of the method according to this invention have the following features:

(1) The wet state of the outermost surface layer is its semi-dry state;

(2) A solvent is applied to the dry surface of the outermost surface layer to wet it again and thereby obtain its wet state;

(3) A coating liquid for forming the thermal recording layer or a protective layer is applied to the dry surface of the outermost surface layer to wet it again and thereby obtain its wet state;

(4) The amount of the liquid which is applied to the dry surface of the outermost surface layer is so controlled as to form a constant pool at the inlet of an area of contact between the dry surface of the layer and the surface of the smooth body;

(5) The support is a sheet of undercoated paper having an air permeability not exceeding 300 seconds;

(6) The thermal recording layer comprises a plurality of layers which are adapted for producing different hues; and (7) The thermal recording layer is formed by applying a coating liquid to the surface of the smooth body, drying it and transferring it onto the support or an undercoated support.

According to this invention, there is also provided a high-grade thermal recording sheet comprising on a support at least one thermal recording layer adapted for developing color when heated and having a surface which is so smooth that when a first straight line extending in parallel to the centerline of a roughness curve as obtained in accordance with the method of JIS B 0601 crosses the roughness curve with a contact ratio of 10%, a second straight line extending in parallel to the centerline and between it and the first straight line and having a distance of 1.5 μm from the first straight line crosses the roughness curve with a contact ratio of at least 80%.

Some preferred features of the sheet according to this invention include the following:

(1) The second straight line crosses the roughness curve with a contact ratio of at least 90%; and (2) The sheet has a dull surface having a degree of luster not exceeding 30%.

The support for the thermal recording sheet of this invention may, for example, comprise a sheet of paper, such as wood free paper, machine glazed paper, coated paper or synthetic paper, or a film of plastics, such as polyethylene terephthalate, polyethylene or polypropylene.

The thermal coloring material which is used for forming the thermal recording layer may be selected from, for example, (1) a combination of a leuco dye of e.g. the fluoran, triphenylmethane, spiropyran, auramine or phenothiazine series and a color developing agent which reacts with it to develop its color when heated, (2) a combination of resorcin and a nitroso compound which can form an oxazine or azo dye, (3) a combination of a diazonium salt and a coupler which can form an azo dye, (4) a combination of a compound having a secondary alcoholic hydroxy group with an inorganic metal salt or a metal acetate, (5) a combination of a carbohydrate and a dehydrating agent, (6) a combination of a metal salt of a higher fatty acid and a phenolic compound, (7) a combination of a heavy metal salt of an organic acid and an alkaline earth metal sulfide, (8) a combination of a heavy metal salt of an organic acid and an organic chelating agent, (9) a combination of a heavy metal oxalate and a sulfur compound, (10) a combination of a metal salt of a fatty acid and an aromatic polyhydroxy compound, (11) a combination of a noble metal salt of an organic acid and an organic polyhydroxy compound, (12) a combination of a noble metal salt of an organic acid and an aromatic organic reducing agent and (13) a combination of a heavy metal salt of a higher fatty acid and zinc dialkyl dithiocarbamate. Any other composition can also be used if it develops color when heated.

Specific examples of the leuco dyes which can be used include 3,3-bis(p-dimethylaminophenyl)phthalide, 3,3-bis(p-dimethylaminophenyl)-6-dimethylphthalide, 3,3-bis(p-dimethylaminophenyl)-6-aminophthalide, 3,3-bis(p-dimethylaminophenyl)-6-nitrophthalide, 3,3-bis(p-dimethyl-aminophenyl)-4,5,6,7-tetrachlorophthalide, 3-dimethylamino-7-methylfluoran, 3-diethylamino-7-chlorofluoran, 3-diethylamino-6-methyl-7-phenylaminofluoran, 3-N-ethyl-N-pentylamino-6-methyl-7-phenylaminofluoran, 3-N-methyl-N-cyclohexylamino-6-methyl-7-phenylaminofluoran, 3-diamino-7-o-chlorophenylaminofluoran, 3-diethylamino-7-o-chlorophenylaminofluoran, 3-N-ethyl-N-p-tolyl-6-methyl-7-phenylaminofluoran, 3-pyrrolidino-6-methyl-7-phenylaminofluoran, 3-diethylamino-6-methyl-7-p-n-butylphenylaminofluoran, 3-N-methyl-N-propylamino-6-methyl-7-phenylaminofluoran, 3-dibutylamino-7-o-fluorophenylaminofluoran, 3-diethylamino-7-trifluoromethylphenylaminofluoran, 3-N-ethyl-p-toluidino-7-methylphenylaminofluoran, Rhodamine B lactam, 3-methylspirodinaphthopyran, 3-ethylspirodinaphthopyran and 3-benzylspironaphthopyran.

Specific examples of the color developing agent which can be used include 4-phenylphenol, 4-hydroxyacetoquinone, 2,2'-dihydroxydiphenyl, n-butylbis(4-hydroxyphenyl) acetate, methylbis(4-hydroxyphenyl)acetate, iso-butylbis (4-hydroxyphenyl)acetate, 2,2'-methylenebis(4-chlorophenol), 2,2'-methylenebis(4-methyl-6-t-butylphenol), 4,4'-isopropylidenediphenol (i.e. bisphenol A; BPA), 4,4'-isopropylidenebis (2-chlorophenol), 4,4'-isopropylidenebis (2-methylphenol), 1,1-bis(4-hydroxyphenyl)-1-phenylethane, 1,3-di[2-(4-hydroxyphenyl)-2-propyl]benzene, 4,4'-ethylene-bis(2-methylphenol), 4,4'-thiobis(6-t-butyl-3-methylphenol), resorcinol monobenzoate, 1,1-bis(4-hydroxyphenyl)-cyclohexane, 2,2'-bis(4-hydroxyphenyl)-N-heptane, 4,4'-cyclohexylidenebis (2-isopropylphenol), 4,4'-dihydroxy-diphenylsulfone, 4-hydroxy-4'-iso-propyloxy-diphenylsulfone, 4,4'-dihydroxy-3,3'-diallyldiphenylsulfone, salicylic acid anilide, a phenolic novolak, benzoic acid, p-t-butylbenzoic acid, o-chlorobenzoic acid, p-chlorobenzoic acid, dichlorobenzoic acid, trichlorobenzoic acid, m-hydroxybenzoic acid, p-hydroxybenzoic acid, p-hydroxybenzoic acid benzylester, o-toluylic acid, m-toluylic acid, p-toluylic acid, phthalic acid, isophthalic acid, terephthalic acid, gallic acid, trimellitic acid, salicylic acid, 3-ethylsalicylic acid, 4-ethylsalicylic acid, 3-phenylsalicylic acid, 5-phenylsalicylic acid, 3-hydroxysalicylic acid, 4-hydroxysalicylic acid, 5-hydroxysalicylic acid, 6-hydroxysalicylic acid, dimethyl 4-hydroxyphthalate, $\alpha$-naphthoic acid and $\beta$-naphthoic acid.

A binder is added to the thermal coloring material. It is possible to use a natural binder, such as starch, cellulose or protein, or a synthetic binder, such as polyvinyl alcohol, acrylic resin or styrene, or any other resin that is soluble in water or an organic solvent.

A pigment is added to increase the whiteness and opacity of the layer and improve its travel past a thermal head. It is possible to use an inorganic pigment, such as calcium or magnesium carbonate, silicic acid, aluminum silicate, barium sulfate, titanium dioxide or zinc oxide, or an organic pigment of e.g. the acrylic or styrene series.

Other additives include a thermoplastic substance such as paraffin wax, stearic acid amide, ethylenebis-stearamide, zinc stearate or calcium stearate, a surface active agent such as sodium dioctylsulfosuccinate or dodecylbenzenesulfonate or other sulfonate or a phosphoric acid ester, an ultraviolet absorbing agent of e.g. the benzophenone or triazole series, and a fluorescent dye.

A releasing agent, such as of the silicone or fluorine series, or Turkey red oil, is preferably used for improving the separation of the layer from the smooth body.

The thermal coloring material, binder, pigment and other additives are appropriately mixed to prepare the coating liquid which is used to form the thermal recording layer. The liquid preferably contains, for example, 5 to 50% of the thermal coloring material, 3 to 40% of the binder, 5 to 60% of the pigment and not more than 50% of other additives.

Water, toluene, mineral spirit, hexane or any other liquid that can dissolve or wet the binder can be used for wetting the surface of the layer.

The coating liquid which is applied to the dry surface of the thermal recording layer may be of the same composition as that of the liquid which is used for forming the layer. It is, however, sometimes preferable to use a liquid of different composition. For example, if a high degree of preservability is, among others, desired, it is effective to use a liquid containing a smaller amount of the thermal coloring material and a larger amount of the binder, a liquid containing a binder, which provides a high preservability, or a liquid containing an ultraviolet absorbing agent. If a high degree of sensitivity is particularly desired, it is effective to use a liquid containing a larger amount of a thermal coloring material of higher sensitivity.

There is no particular limitation to the coating weight of the thermal recording layer. However, its total dry weight including the weight of the layer which is transferred or wetted again is usually from 2 to 25 g/m$^2$ and preferably from 4 to 15 g/m$^2$. The protective layer not containing any thermal coloring material or the layer containing a smaller amount of thermal coloring material has a coating weight not exceeding 10 g/m$^2$, and preferably not exceeding 5 g/m$^2$.

The surface of the thermal recording sheet according to this invention can be made by any ordinary method of the type in which it is brought into intimate contact with the smooth body when the coating liquid is still plastic, and separated therefrom when its plasticity has disappeared. More specifically, it is preferable to either of the following two methods:

Method A

The layer to be transferred is formed on the smooth body and is transferred onto the support to produce a thermal recording sheet. When the layer which has been formed on the smooth body is in a semi-dry state, or after it has been completely dried, it is joined to the surface of the support or of the thermal recording layer by an adhesive material and the sheet is thereafter separated from the smooth body. The layer to be transferred does not necessarily contain any thermal coloring material if the support already carries a thermal recording layer. It is sufficient that the final product has at least one layer containing a thermal coloring material. If the adhesive is of the type which requires drying after it has joined the surface of the smooth body to the support, it is preferably for the support to be of a material having a gas permeability not exceeding 300 seconds. If the adhesive does not require any such drying, however, the support can be of any film that is impermeable to gas.

Method B

The thermal recording layer which has been formed on the support is brought into contact with the surface of the smooth body, dried thereon, and separated therefrom. The layer is brought into contact with the surface of the smooth body either when it is in a semi-dry state, or after it has been dried and wetted again, or after it has been dried and coated with the liquid which is used for forming the thermal recording or protective layer. It is, among others, preferable from the standpoint of production stability or reliability to bring the layer into contact with the smooth body after it has once been dried and has been coated with the liquid again. In this connection, it is preferable to control the supply of the liquid so that it may form a constant pool at the inlet of the area where the support is brought into contact with the smooth body. When this method is employed, it is appropriate to use a sheet of air-permeable paper as the support. It is possible to provide it with an undercoating layer consisting mainly of a pigment and a binder and having a coating weight of, say, 3 to 15 g/m$^2$, and even a back coating layer, too.

The smooth body which is used for carrying out the method A or B may be in the form of a sheet, roll, or endless belt having a smooth surface. Its surface must be so smooth that when a first straight line extending in parallel to the centerline of a roughness curve as obtained in accordance with the method of JIS B 0601 crosses the curve with a contact ratio of 90%, a second straight line extending in parallel to the centerline and on the opposite side of the first straight line from the centerline and having a distance of 1.5 μm from the first straight line crosses the roughness curve with a contact ratio not exceeding 20%, and preferably not exceeding 10%. If the second straight line crosses the roughness curve with a contact ratio exceeding 20%, the smooth body fails to produce any high-grade thermal recording sheet.

A smooth body having a glossy surface is used for producing a thermal recording sheet having a glossy surface. On the other hand, a smooth body having a dull surface obtained by e.g. chemical treatment or sand-blasting is used for producing a thermal recording sheet having a dull surface. In either event, its surface smoothness must satisfy the requirement which has hereinabove been described.

The smooth body may be formed from, for example, a film of plastics, such as PET, PP or PE, or a metal. Its surface is preferably coated with a metal or a resin such as teflon. It is effective to treat its surface with silicone, fluorine, a surface active agent, wax, etc. in order to facilitate the separation of the thermal recording sheet therefrom. According to this invention, it is preferable from the standpoints of easy use, durability and easy separation to use a roll having a surface plated with chromium. The teflon coating of a chromium-plated surface provides a body which is particularly excellent from the standpoint of sheet separation.

BEST MODE OF CARRYING OUT THE INVENTION

Figure 1:
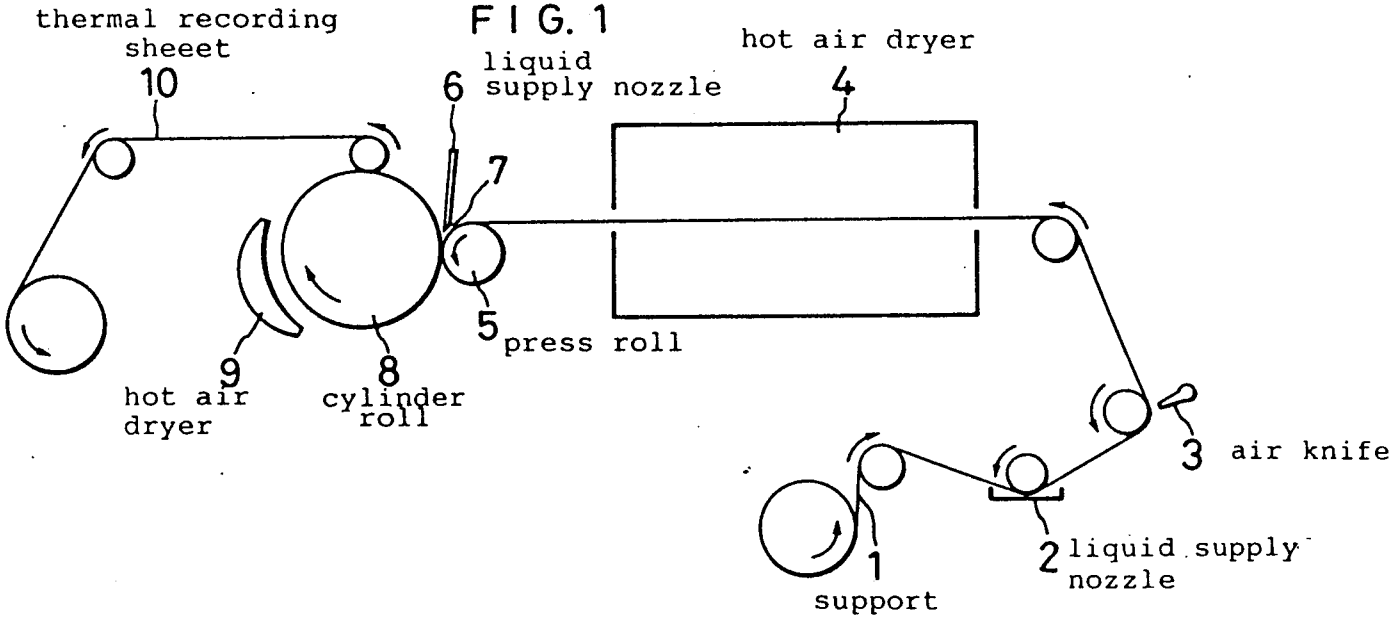
FIG. 1 is a diagrammatic representation of the apparatus used for manufacturing a thermal recording sheet in the examples of this invention which will hereinafter be described.
Figure 2:
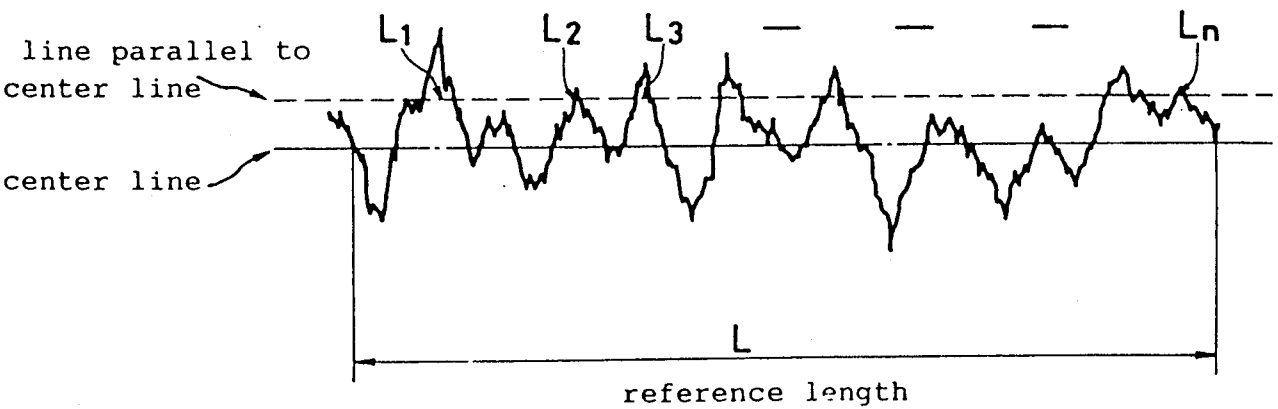
FIG. 2 is a diagram showing a roughness curve and explaining a method of obtaining a 'contact ratio'.

The invention will now be described more specifically with reference to a plurality of examples which are not intended for limiting the scope of this invention, but are merely intended for illustrating it. The results of measurements on various properties which will hereinafter appear were obtained by the following methods:

(1) Gloss

A gloss meter GM-3 made by Murakami Color Research Laboratory, Inc. was employed at an angle of 75°.

(2) Picture quality and sensitivity

A picture was prepared with an applied voltage of 6.0 V and a pulse width of 1.0 to 3.4 ms by using a testing machine made by Matsushita Electronic Parts Co., Ltd. and its density was determined by a Macbeth reflective densitometer RD-914. The picture was also evaluated for dot reproducibility visually and through an enlarged photograph.

(3) Smoothness

An "OHKEN" smoothness measuring instrument was used.

(4) Appearance

The sheet was visually examined for luster unevenness and surface contamination.

(5) Optical surface roughness Rp

A microtopograph made by K. K. Toyo Seiki Seisakusho was used for measuring the roughness by employing an applied pressure of 10 kgf/cm$^2$ and a sampling time of 100 ms.

(6) The average wavelength $R_{\lambda a}$, centerline average roughness $R_a$ and 10-point average roughness RRZ were determined by the device SURFCOM 1500A.

EXAMPLE 1

10 parts of 3-N-ethyl-N-pentylamino-6-methyl-7-phenylaminofluoran, leuco dye S-205 produced by Yamada Chemical Industrial Co., Ltd., 20 parts of p-hydroxybenzoic acid benzylester, 5 parts of dibenzylterephthalic acid, 10 parts of zinc stearate and 30 parts of calcium carbonate were each ground by a sand grinder until they had an average particle diameter not exceeding 2 μm. They and 20 parts of a binder (15 parts of oxidized starch and 5 parts of PVA) were mixed with water to prepare a coating liquid A having a solid content of 23%.

A web of machine glazed paper 1 having a coating weight of 47 g/m$^2$ was used as a support. The liquid A was applied to the glossy surface of the paper 1 by an air knife 3 in a cast coater of the type shown in FIG. 1 until a dry coating weight of 3 g/m$^2$ was obtained. Then, the paper 1 was dried in a hot air dryer 4 and brought into contact with the smooth surface of a cylinder roll 8 by a press roll 5 having a hardness of 90°. The liquid A was supplied through a liquid supply nozzle 6 to the inlet of the clearance between the press roll 5 and the cylinder roll 8 to form a constant pool 7 therein. The pressure which was applied to the paper was so controlled that the liquid which was applied for wetting the paper again might have a dry weight of 1 g/m$^2$, or a total of 4 g/m$^2$ including its weight which had been applied by the air knife 3. The paper was, then, dried by a hot air dryer 9, while maintaining its contact with the smooth surface of the roll 8, and was thereafter separated therefrom, whereby a thermal recording sheet 10 was obtained.

The surface of the cylinder roll 8 (smooth body) was a mirror surface obtained by the buffing of a chromium plated surface. The thermal recording sheet was of excellent image quality and sensitivity, as having a surface which was so smooth that the second straight line having a distance of 1.5 μm from the first straight line having a contact ratio of 10% with the roughness curve had a contact ratio of 90% with the roughness curve. It had a uniformly glossy surface having a gloss of 45%. Further details of its properties are shown in TABLE 1.

EXAMPLE 2

A thermal recording sheet was produced by repeating the method of EXAMPLE 1, except that a cylinder roll having a dull surface was used as the smooth body. Its dull surface had been obtained by the sand blasting of a chromium plated and buffed surface. The sheet was of excellent image quality and sensitivity, as having a surface which was so smooth that the second straight line having a distance of 1.5 μm from the first straight line had a contact ratio of 93% with the roughness curve. It had a uniformly dull surface having a gloss of 17%. Further details of its properties are shown in TABLE 1.

COMPARATIVE EXAMPLE 1

The liquid A which prepared in EXAMPLE 1 was applied to a support until a dry coating weight of 6 g/m$^2$ was obtained. It was dried in a hot air dryer and wound into a roll. The thermal recording sheet which had been obtained was coated again with the liquid A until a dry coating weight of 2 g/m$^2$ (or a total of 8 g/m$^2$) was obtained, and was dried by a hot air dryer. The sheet had a surface of low smoothness and was, therefore, supercalendered. It was, however, still unsatisfactory both in image quality and in sensitivity. Its surface had a gloss of 28%. Its contamination and luster unevenness were apparently due to its calendering. Its surface smoothness was such that the second straight line having a distance of 1.5 μm from the first straight line had a contact ratio of only 53% with the roughness curve. Further details of its properties are shown in TABLE 1.

EXAMPLE 3

Five parts of leuco dye S-205, 20 parts of bisphenol A and 25 parts of ethylenebisstearamide were each ground in an attritor until they had an average particle diameter not exceeding 2 μm. They were mixed together and a binder was added to their mixture. The binder consisted of 30 parts of a 10% aqueous solution of PVA, 70 parts of a 10% aqueous solution of oxidized starch and 40 parts of a 35% emulsion of a styrene-maleic acid copolymer. Moreover, 60 parts of a 20% dispersion of silica were added as a pigment to the mixture, whereby a transfer coating liquid B having a solid content of 22% was prepared.

The liquid B was applied by a wire bar to a smooth body cut in a B4 size and having a glossy surface (a 75 μm thick film of PET sold by Toray Corporation and known as Lumilar) until a wet coating weight of 10 g/m$^2$ was obtained. It was dried by a stream of hot air until it turned into a semi-dry state when inspected visually and by a finger touch. Then, it was brought into contact with a support by rubber rollers and dried. The support was a sheet of machine glazed paper and a weight of 47 g/m$^2$ to which the liquid A had been applied to form a layer having a dry weight of 6 g/m$^2$, whereby the liquid B was transferred onto the paper to produce a thermal recording sheet. It had an excellent surface smoothness and was of excellent image quality and sensitivity. Its uniformly glossy surface had a gloss of 85%.

EXAMPLE 4

A thermal recording sheet was produced repeating the method of EXAMPLE 3, except for the use of a smooth body having a dull surface obtained by the sand blasting of the surface of the smooth body which had been used in EXAMPLE 3. It showed a uniformly dull surface having a gloss of 15% and was of high image quality and sensitivity.

COMPARATIVE EXAMPLE 2

A thermal recording sheet was produced by repeating the method of EXAMPLE 3, except for the use of a smooth body having a dull surface obtained by the sand blasting of the surface of the smooth body which had been used in EXAMPLE 3. It showed a uniformly dull surface having a gloss of 13%. However, the layer which had been transferred had some defective portions which were apparently due to improper separation of the smooth body. The sheet was, therefore, of somewhat low image quality and sensitivity.

EXAMPLE 5

10 parts of leuco dye S-205 of Yamada Chemical Industrial Co., Ltd. (3-N-ethyl-N-pentylamino-6-methyl-7-phenylaminofluoran), 25 parts of p-hydroxybenzoic acid benzylester, 5 parts of dibenzyl terephthalate, 15 parts of zinc stearate and 30 parts of aluminum silicate were each ground in a sand grinder until they had an average particle diameter not exceeding 2 μm. They and 20 parts of a binder (10 parts of PVA and 10 parts of oxidized starch) were mixed with water to prepare a coating liquid C having a solid content of 22%.

The liquid C was applied to the glossy surface of a sheet of machine glazed paper and having a weight of 47 g/m$^2$ until a dry coating weight of 7 g/m$^2$ was obtained at the coater head 3 of the coater shown in FIG. 1. The paper was dried in the hot air dryer 4 until its coated layer had a water content of about 50%. Then, the coated surface of the paper was brought into contact with the cylinder roll 8, dried and separated therefrom, whereby a thermal recording sheet was obtained.

The cylinder roll 8 had a surface coated with a fluororesin for facilitating the separation of the sheet therefrom. The roll had a surface temperature controlled to a range of 50° C. to 60° C. The hot air dryer 9 was provided outside the roll for promoting the drying of the sheet.

The sheet was evaluated with respect to various properties. The results are shown in TABLE 1. As is obvious therefrom, it had a smoothness of 3000 sec., was free from any fogging and was of excellent image quality and sensitivity.

EXAMPLE 6

Preparation of a coating liquid D for a thermal recording layer 10 parts of leuco dye PSD-150 (product of Shin-Nisso Kako K. K.), 30 parts of bisphenol A, 10 parts of ethylenebisstearylamide and 40 parts of calcium stearate were each ground in a sand mill until they had an average particle diameter not exceeding 2 μm. They and 25 parts of polyvinyl alcohol as a binder were mixed with water to produce a coating liquid D.

Formation of a thermal recording layer

The liquid D was applied to a sheet of paper having a weight of 60 g/m$^2$ so that a dry coating weight of 6 g/m$^2$ might be obtained, and was dried, whereby a thermal recording sheet was produced.

Preparation of a coating liquid E for a protective layer

A coating liquid E for forming a protective layer was prepared by mixing with water 60 parts of an acrylic coating agent (a 15% aqueous solution of F-846 produced by Showa Denko), 20 parts of oxidized starch (a 15% aqueous solution of MS-3600 produced by Nippon Shokuhin), 10 parts of a 50% aqueous dispersion of clay, 10 parts of a 30% aqueous dispersion of zinc stearate and 1 part of dimethylolurea.

The liquid E was applied to the recording layer of the thermal recording sheet so that a dry coating weight of 3 g/m² might be obtained. The coated surface was brought into contact with the chromium plated surface of a cylindrical roll, dried and separated therefrom, whereby a thermal recording sheet coated with a protective layer and having a Bekk smoothness of 1000 sec. was obtained. The properties of the sheet are shown in TABLE 1.

EXAMPLE 7

Liquid F (Component for thermal recording layer, the first layer for black color development)

Ten parts of leuco dye (3-N-methyl-N-cyclohexylamino-6-methyl-7-phenylaminofluoran; PSD-150 produced by Shin-Nisso Kako K. K.), 30 parts of bisphenol A and 20 parts of zinc stearate were each ground to particles having average particle size of smaller than 2 μm by means of sand grinder and then mixed and dispersed. Subsequently, 100 parts of 30% dispersion of aluminum silicate were added thereto, and then 80 parts of 10% aqueous PVA solution and 70 parts of 10% aqueous solution of oxidized starch were added as a binder, whereby Liquid F was prepared. This coating liquid was used in a concentration of 20%.

Liquid G (Component for thermal recording layer, the second layer for blue color development)

10 parts of a leuco dye known as Crystal Violet Lactone (CVL), 20 parts of bisphenol A, 10 parts of 1-hydroxy-2-naphthoic acid phenylester (HS-1094 of Dainippon Ink & Chemical) and 20 parts of zinc stearate were each ground in a sand grinder until they had an average particle diameter not exceeding 2 μm. They were mixed together and 100 parts of a 40% dispersion of calcium carbonate were added to their mixture. Moreover, 200 parts of a 10% aqueous solution of PVA were added as a binder to thereby prepare a coating liquid G for forming a second thermal recording layer for developing a blue color. It had a solid content of 22%.

The liquid F was applied to a sheet of wood free paper having a weight of 53 g/m² by an air knife coater so that a dry coating weight of 6 g/m² might be obtained, whereby a first layer for developing a black color was formed. Then, the liquid G was applied to the first layer by the air knife coater so that a second layer having a dry weight of 4 g/m² might be formed. While the layer was in a semi-dry state, it was brought into contact with a chromium plated metal roll by a press roll, dried and separated therefrom, whereby a thermal recording paper adapted for developing multiple colors was produced. It had a smoothness of 350 sec. and was free from any fogging.

It was used for producing a picture having a blue color by employing an applied voltage of 12.0 V and a pulse width of 3.0 ms and a picture having a black color by employing an applied voltage of 16.0 V and a pulse width of 2.5 ms. The picture having a blue color had a density which was as high as 0.55, and the picture having a black color also showed a density as high as 1.37. A high degree of dot reproducibility was obtained and there was no mixing of the colors.

COMPARATIVE EXAMPLE 3

An undercoating liquid H having a solid content of 30% was prepared by mixing 50 parts of silicon dioxide (MIZKASIL P-832 of Mizusawa Kagaku Kogyo K. K. having an average particle diameter of 2.7 μm) and 50 parts of an organic hollow pigment (ROPAQUE OP-84J of Nippon Acrylic Chemical Co., Ltd. having an average particle diameter of 0.55 μm) as pigments with 30 parts of a styrene-butadiene copolymer latex having a solid content of 48% as a binder. The liquid H was applied to a sheet of wood free paper having a weight of 45 g/m² to prepare a support carrying an undercoating layer having a dry weight of 7 g/m². Otherwise, the method of COMPARATIVE EXAMPLE 1 was repeated for producing a thermal recording sheet. Its properties are shown in TABLE 1.

As is obvious from TABLE 1, all of the thermal recording sheets having an average wavelength not exceeding 60 μm were of excellent image quality and appearance.

INDUSTRIAL UTILITY

The surface of a thermal recording sheet which is obtained by drying in contact with a smooth body, while it is wet, is so smooth that when the first straight line extending in parallel to the centerline of the roughness curve as obtained in accordance with the method of JIS B 0601 crosses the roughness curve with a contact ratio of 10%, the second straight line extending in parallel to the centerline and spaced inwardly from the first straight line by a distance of 1.5 μm crosses the roughness curve with a contact ratio of at least 80%. The sheet having such a smooth surface on its thermal recording layer is easy to bring into intimate contact with a thermal head and is of excellent image quality and sensitivity. If a smooth body having a glossy or dull surface is used, it is possible to produce a thermal recording sheet having a uniformly glossy or dull surface without lowering its image quality or sensitivity.

TABLE 1

| | Example 1 | Ex. 2 | Ex. 3 | Ex. 4 | Ex. 5 | Ex. 6 | Ex. 7 | Com. Ex. 1 | Com. Ex. 2 | Com. Ex. 3 |
|---|---|---|---|---|---|---|---|---|---|---|
| Image quality (*2) | A | A | A | A | B | A | A | D | C | C |
| Sensitivity (at pulse width of 1.6 ms) | 1.08 | 1.07 | 1.14 | 1.12 | 1.13 | 0.92 | — | 0.98 | 1.05 | 1.03 |
| Appearance (*2) | A | A | A | A | B | A | A | D | B | C |
| Gloss (%) | 45 | 17 | 85 | 15 | 38 | 73 | 57 | 28 | 13 | 22 |
| Contact ratio (*1) | 90 | 93 | 98 | 90 | 84 | 96 | 98 | 53 | 79 | 72 |
| Average wavelength (μm) | 33 | 31 | 50 | 36 | 47 | 52 | 29 | 75 | 63 | 69 |
| Smoothness (sec) | 960 | 490 | 2000 | 450 | 3000 | 1000 | 350 | 680 | 430 | 500 |
| Ra (μm) | 0.63 | 0.64 | 0.72 | 0.69 | 0.87 | 0.47 | 0.60 | 0.83 | 0.77 | 0.61 |
| RRZ (μm) | 2.9 | 3.1 | 1.8 | 3.2 | 3.5 | 2.0 | 2.3 | 3.6 | 3.3 | 2.5 |

TABLE 1-continued

| | Example 1 | Ex. 2 | Ex. 3 | Ex. 4 | Ex. 5 | Ex. 6 | Ex. 7 | Com. Ex. 1 | Com. Ex. 2 | Com. Ex. 3 |
|---|---|---|---|---|---|---|---|---|---|---|
| Rp (μm) | 0.61 | 1.67 | 0.20 | 2.18 | 0.93 | 0.56 | 0.37 | 1.91 | 1.59 | 1.80 |

*1 Contact ratio of a line spaced 1.5 μm inwardly from a line having a contact ratio of 10%.
*2 Evaluation: A: Very good, B: good, C: Poor, D: Bad

We claim:

1. In a method of manufacturing a high-grade thermal recording sheet having on a support an outermost surface layer defining a thermal recording layer adapted for developing color when heated, the improvement which comprises bringing said outermost surface layer into contact with the surface of a smooth body when said layer is in a wet state, drying it and separating it from said surface of said smooth body.

2. A method as set forth in claim 1, wherein said wet state of said outermost surface layer is its semi-dry state.

3. A method as set forth in claim 1, wherein said wet state of said outermost surface layer is obtained by wetting its dry surface again with a solvent.

4. A method as set forth in claim 1, wherein said wet state of said outermost surface layer is obtained by wetting its dry surface again with a coating liquid for forming said thermal recording layer or a protective layer covering it.

5. A method as set forth in claim 4, wherein said liquid is supplied in an amount so controlled as to form a constant pool in an area in which said dry surface begins to contact said surface of said smooth body.

6. A method as set forth in claim 1, wherein said support is a sheet of coated paper having an air permeability not exceeding 300 seconds.

7. A method as set forth in claim 1, wherein said thermal recording layer comprises a plurality of layers which are adapted for producing different colors.

8. A method as set forth in claim 1, wherein said thermal recording layer is formed by applying a coating liquid to said surface of said smooth body, drying it and transferring it onto one of said support and a support having a coating thereon.

* * * * *